US011358779B2

(12) United States Patent
Tye

(10) Patent No.: US 11,358,779 B2
(45) Date of Patent: Jun. 14, 2022

(54) CONTAINER WITH LINER

(71) Applicant: Graphic Packaging International, Inc., Atlanta, GA (US)

(72) Inventor: Paul Tye, Buckinghamshire (GB)

(73) Assignee: Graphic Packaging International, LLC, Atlanta, GA (US)

( * ) Notice: Subject to any disclaimer, the term of this patent is extended or adjusted under 35 U.S.C. 154(b) by 344 days.

(21) Appl. No.: 15/654,814

(22) Filed: Jul. 20, 2017

(65) Prior Publication Data

US 2018/0022529 A1 Jan. 25, 2018

Related U.S. Application Data

(60) Provisional application No. 62/365,635, filed on Jul. 22, 2016.

(51) Int. Cl.
*B65D 81/34* (2006.01)
*B65D 77/22* (2006.01)
(Continued)

(52) U.S. Cl.
CPC ..... *B65D 81/3453* (2013.01); *B65D 5/209* (2013.01); *B65D 5/563* (2013.01); *B65D 7/08* (2013.01); *B65D 7/26* (2013.01); *B65D 77/0413* (2013.01); *B65D 77/22* (2013.01); *B65D 2581/055* (2013.01); *B65D 2581/347* (2013.01); *B65D 2581/3472* (2013.01); *B65D 2581/3479* (2013.01)

(58) Field of Classification Search
CPC .... B65D 81/3453; B65D 5/209; B65D 5/563; B65D 7/08; B65D 7/26; B65D 77/0413; B65D 77/22; B65D 2581/055; B65D 2581/347; B65D 2581/3472; B65D 2581/3479; B65D 5/2033; B65D 5/2047; B65D 5/242; B65D 5/243
USPC ..... 206/557
See application file for complete search history.

(56) References Cited

U.S. PATENT DOCUMENTS 3,104,012 A 9/1963 Beamish
3,154,215 A 10/1964 Vesconte
(Continued)

FOREIGN PATENT DOCUMENTS

CA 2 814 149 A1 4/2012
CN 203450620 U 2/2014
(Continued)

OTHER PUBLICATIONS

International Search Report and Written Opinion for PCT/US2018/042431 dated Dec. 14, 2018.
(Continued)

*Primary Examiner* — Andrew D Perreault
(74) *Attorney, Agent, or Firm* — Womble Bond Dickinson (US) LLP

(57) ABSTRACT

A container for heating a food product. The container comprises a base layer of material and a liner releasably attached to an inner surface of the base layer. The liner is separable from the base layer after heating the container. The container comprises a bottom panel, and end panel foldably connected to the bottom panel, a side panel foldably connected to the bottom panel, and a corner panel foldably connected to the bottom panel. The corner panel extends between the end panel and the side panel.

35 Claims, 6 Drawing Sheets

(51) Int. Cl.

| | |
|---|---|
| ***B65D 77/04*** | (2006.01) |
| ***B65D 5/56*** | (2006.01) |
| ***B65D 5/20*** | (2006.01) |
| ***B65D 6/04*** | (2006.01) |
| ***B65D 6/18*** | (2006.01) |

(56) References Cited

U.S. PATENT DOCUMENTS

| | | | | |
|---|---|---|---|---|
| 3,575,338 | A | | 4/1971 | Dilot |
| 3,640,188 | A | | 2/1972 | Dilot |
| 3,893,882 | A | | 7/1975 | Repenning |
| 3,941,301 | A | | 3/1976 | Jorgensen |
| 4,057,380 | A | | 11/1977 | Hosoe |
| 4,130,236 | A | * | 12/1978 | Manizza ..... B65D 5/2023 229/114 |
| 4,283,427 | A | | 8/1981 | Winters et al. |
| 4,325,905 | A | | 4/1982 | Takahashi |
| 4,555,381 | A | | 11/1985 | Chazal et al. |
| 4,718,596 | A | | 1/1988 | Muller et al. |
| 4,943,456 | A | | 7/1990 | Pollart et al. |
| 5,000,374 | A | | 3/1991 | Deiger |
| 5,002,826 | A | | 3/1991 | Pollart et al. |
| 5,002,833 | A | | 3/1991 | Kinsey, Jr. et al. |
| 5,118,747 | A | | 6/1992 | Pollart et al. |
| 5,203,491 | A | | 4/1993 | Marx et al. |
| 5,326,021 | A | * | 7/1994 | Farrell ..... B65D 5/2033 229/109 |
| 5,410,135 | A | | 4/1995 | Pollart et al. |
| 5,412,187 | A | | 5/1995 | Walters et al. |
| 5,530,231 | A | | 6/1996 | Walters et al. |
| 5,533,622 | A | | 7/1996 | Stockley, III |
| 5,533,623 | A | | 7/1996 | Fischer |
| 5,647,168 | A | | 7/1997 | Gilbert |
| 6,092,687 | A | | 7/2000 | Hupp et al. |
| 6,204,492 | B1 | | 3/2001 | Zeng et al. |
| 6,234,386 | B1 | | 5/2001 | Drummond et al. |
| 6,433,322 | B2 | | 8/2002 | Zeng et al. |
| 6,552,315 | B2 | | 4/2003 | Zeng et al. |
| 6,677,563 | B2 | | 1/2004 | Lai |
| 8,534,460 | B2 | | 9/2013 | Wnek et al. |
| 8,801,995 | B2 | | 8/2014 | Wnek et al. |
| 2005/0031814 | A1 | | 2/2005 | Dawes |
| 2007/0116806 | A1 | | 5/2007 | Parsons |
| 2008/0035634 | A1 | | 2/2008 | Zeng et al. |
| 2011/0174676 | A1 | | 7/2011 | Stockhaus |
| 2011/0259784 | A1 | | 10/2011 | Tye et al. |
| 2012/0248180 | A1 | | 10/2012 | White et al. |
| 2014/0183198 | A1 | | 7/2014 | Slack |
| 2014/0224866 | A1 | | 8/2014 | Littlejohn et al. |
| 2015/0225120 | A1 | | 8/2015 | Wnek et al. |
| 2017/0341355 | A1 | | 11/2017 | Peiffer et al. |
| 2018/0022529 | A1 | | 1/2018 | Tye |
| 2018/0319568 | A1 | | 11/2018 | Tye |

FOREIGN PATENT DOCUMENTS

| | | | |
|---|---|---|---|
| DE | 100 22 552 | | 11/2001 |
| EP | 1 104 744 | A2 | 6/2001 |
| GB | 1 501 764 | | 2/1978 |
| GB | 1 602 625 | | 11/1981 |
| GB | 2 487 765 | A | 8/2012 |
| GB | 2 550 386 | A | 11/2017 |
| KR | 10-1539187 | B1 | 7/2015 |
| TW | M 295475 | U | 8/2006 |
| TW | M 301016 | U | 11/2006 |
| WO | WO 2003/041945 | | 5/2003 |
| WO | WO 2007/127371 | | 11/2007 |
| WO | WO 2009/138786 | | 11/2009 |
| WO | WO 2013/002639 | | 1/2013 |
| WO | WO 2014/032059 | A1 | 2/2014 |
| WO | WO 2014/066867 | A1 | 5/2014 |
| WO | WO 2015/009518 | | 1/2015 |
| WO | WO 2019/094057 | A1 | 5/2016 |
| WO | WO 2018/017783 | A1 | 1/2018 |

OTHER PUBLICATIONS

International Search Report and Written Opinion for PCT/US2017/042979 dated Sep. 22, 2017.

Supplementary European Search Report for EP 17 83 1847 dated January.

Office Action for Canadian Patent Application No. 3,027,438 dated Nov. 7, 2019.

Supplementary European Search Report for EP 18 90 9768 dated Oct. 28, 2021.

* cited by examiner

CONTAINER WITH LINER

CROSS-REFERENCE TO RELATED APPLICATIONS

This application claims the benefit of U.S. Provisional Patent Application No. 62/365,635, filed Jul. 22, 2016.

INCORPORATION BY REFERENCE

The disclosures of U.S. Provisional Patent Application No. 62/365,635, filed Jul. 22, 2016, and U.S. patent application Ser. No. 12/992,131, filed Feb. 11, 2011, are hereby incorporated by reference for all purposes as if presented herein in their entirety.

BACKGROUND OF THE DISCLOSURE

The present disclosure relates to blanks, containers, trays, constructs, and various features and methods for forming a container from a blank. More specifically, the disclosure is generally directed to a container having a liner, the container being suitable for heating a food product.

SUMMARY OF THE DISCLOSURE

In general, one aspect of the disclosure is generally directed to a container for heating a food product. The container comprises a base layer of material and a liner releasably attached to an inner surface of the base layer. The liner is separable from the base layer after heating the container. The container comprises a bottom panel, and end panel foldably connected to the bottom panel, a side panel foldably connected to the bottom panel, and a corner panel foldably connected to the bottom panel. The corner panel extends between the end panel and the side panel.

In another aspect, the disclosure is generally directed to, in combination, a blank and a liner material for forming a container for heating a food product. The blank comprises a bottom panel, an end panel foldably connected to the bottom panel, a side panel foldably connected to the bottom panel, and a corner panel foldably connected to the bottom panel. The corner panel can be disposed between the end panel and the side panel so that the corner panel extends between the end panel and the side panel when the container is formed from the blank and the liner material. The blank is for forming a base layer of the container, and the liner material is for being releasably attached to an inner surface of the base layer when the container is formed from the blank and the liner material so that the liner is separable from the base layer after heating of the container formed from the blank and the liner material.

In another aspect, the disclosure is generally directed to a method of forming a container. The method comprises obtaining a blank comprising a bottom panel, an end panel foldably connected to the bottom panel, a side panel foldably connected to the bottom panel, and a corner panel foldably connected to the bottom panel. The method further can comprise forming the blank into an initial construct by folding the end panel, the side panel, and the corner panel with respect to the bottom panel so that the corner panel extends between the end panel and the side panel. The method also can comprise applying a liner material to an inner surface of the initial construct so that the liner material and the initial construct form a respective liner and base layer of the container and so that the liner is releasably attached a liner to the inner surface of the base. The liner is separable from the base layer after heating of the container.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure relates generally to various aspects of containers, constructs, trays, materials, packages, elements, and articles, and methods of making such containers, constructs, trays, materials, packages, elements, and articles. Although several different aspects, implementations, and embodiments are disclosed, numerous interrelationships between, combinations thereof, and modifications of the various aspects, implementations, and embodiments are contemplated hereby. In one illustrated embodiment, the present disclosure relates to forming a container or tray for holding food items or various other articles. However, in other embodiments, the container or tray can be used to form other non-food containing articles or may be used for heating or cooking.

Figure 1:
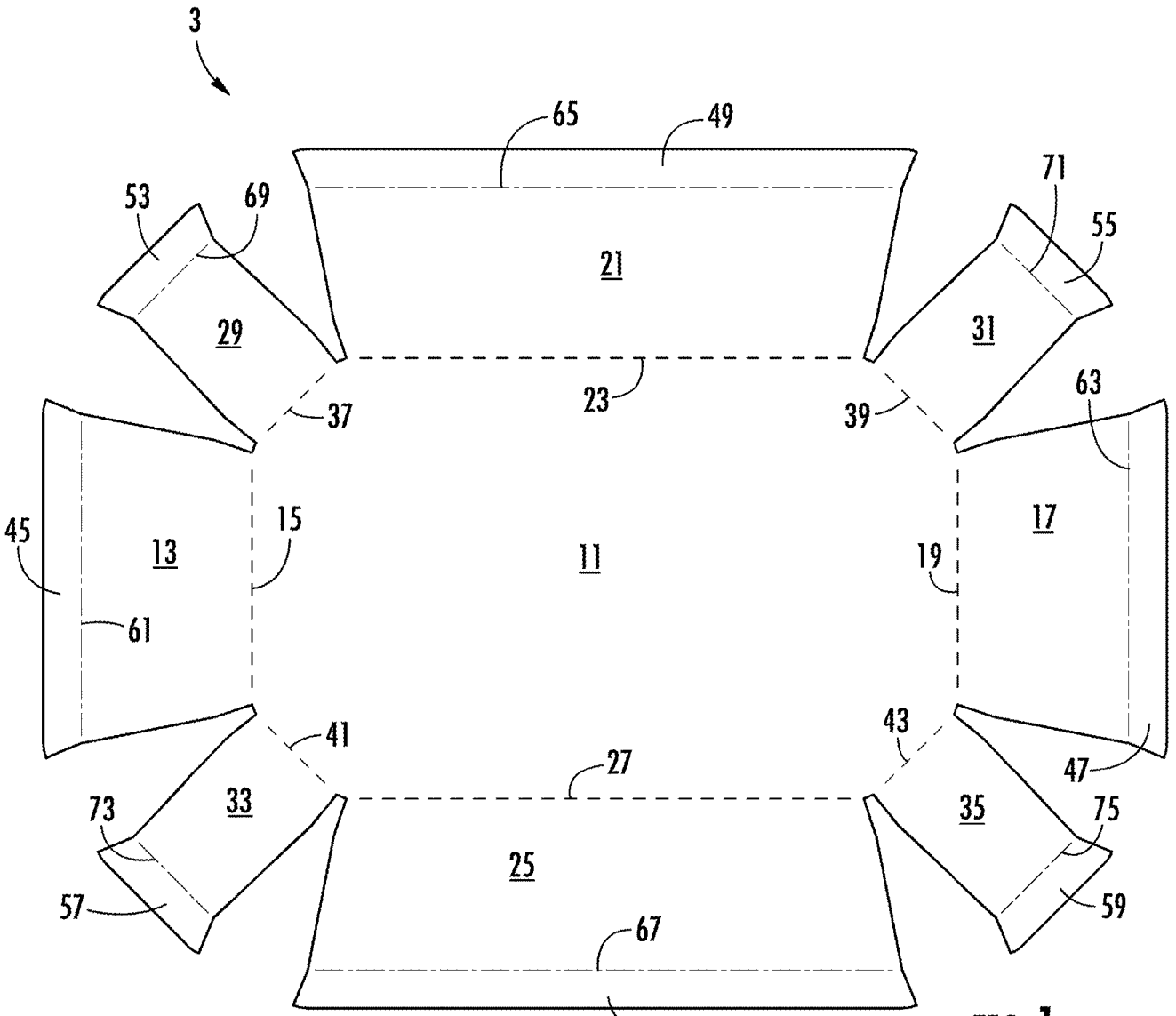
FIG. 1 is a plan view of a blank used for forming a container according to a first exemplary embodiment of the disclosure.

FIG. 1 illustrates a blank 3 that is used to form a container 5 (FIGS. 2 and 3) having a base layer 7 and a liner 9 according to a first embodiment of the disclosure. In one embodiment, the base layer comprises paperboard (e.g., solid bleached sulphate folding boxboard), or other suitable material that can be recyclable, and the liner 9 comprises a plastic layer such as polyethylene, PET material, or any other thermoplastic material, or a bioplastic, such as vegetable oil or starch based plastics. The container 5 is suitable for heating a food product (not shown) in an oven such as a convection or conventional heating oven or microwave oven. In the illustrated embodiment, the liner 9 is adhered to the base layer 7 and is in contact with the food product during heating. After heating the food product, the base layer 7 and the liner 9 can be separated to allow both the base layer 7 and the liner 9 to be recycled separately. U.S. Patent Application Publication No. 2011/0259784, published Oct. 27, 2011, and corresponding to U.S. patent application Ser. No. 12/992,131, filed Feb. 11, 2011, and PCT/GB/09/50506 filed May 13, 2009, is incorporated by reference herein for all purposes. In one embodiment, the '784 publication discloses a method and apparatus that can be used for forming a container 5 of the present disclosure.

The blank 3 can be formed from a single ply of material, such as but not limited to paperboard, cardboard, paper, or a polymeric sheet, but alternatively, the blank can be formed from a laminate that includes more than one layer. In one embodiment, the blank 3 can include a microwave interactive layer (not shown) such as is common in MicroRite® containers available from Graphic Packaging International of Marietta, Ga. The microwave interactive layer can be commonly referred to as, or can have as one of its components, a foil, a microwave shield, or any other term or component that refers to a layer of material suitable for shielding microwave energy and/or causing heating in a microwave oven.

As shown in FIG. 1, the blank 3 has a longitudinal direction L1 and a lateral direction L2. In the illustrated embodiment, the blank 3 has a bottom panel 11, a first end panel 13 foldably connected to the bottom panel at a lateral fold line 15, a second end panel 17 foldably connected to the bottom panel at a lateral fold line 19, a first side panel 21 foldably connected to the bottom panel 11 at a longitudinal fold line 23, and a second side panel 25 foldably connected to the bottom panel at a longitudinal fold line 27. In the illustrated embodiment, the blank 3 includes corner panels 29, 31, 33, 35 respective foldably connected to the bottom panel 11 at respective oblique fold lines 37, 39, 41, 43. As shown in FIG. 1, the corner panels 29, 31, 33, 35 are disposed between respective adjacent end panels 13, 17 and side panels 21 25. In one embodiment, the blank 3 includes eight panels (the two end panels 13, 17, the two side panels 21, 25, and the four corner panels 29, 31, 33, 35) extending around a perimeter of the bottom panel 11 so that the eight fold lines 15, 17, 23, 27, 37, 39, 41, 43 form an octagonal perimeter of the bottom panel 11. As shown in FIG. 1, each of the fold lines 15, 17, 23, 27, 37, 39, 41, 43 can be oblique with respect to its respectively adjacent fold lines and can form an obtuse angle with each of its respectively adjacent fold lines.

In the illustrated embodiment, each of the end panels 13, 17, side panels 21, 25, and corner panels 29, 31, 33, 35 include respective flange portions 45, 47, 49, 51, 53, 55, 57, 59 at least partially defined by respective fold lines 61, 63, 65, 67, 69, 71, 73, 75 extending in the respective panels. In one embodiment, adjacent flange portions 45, 47, 49, 51, 53, 55, 57, 59 are configured to at least partially overlap when the blank 3 is formed into the container 5. The blank 3 can be otherwise shaped, arranged, and/or configured without departing from the disclosure. In addition, any of the bottom panel 11, the end panels 13, 17, the side panels 21, 25, the corner panels 29, 31, 33, 35, and/or the flange portions 45, 47, 49, 51, 53, 55, 57, 59 could be omitted or could be otherwise shaped, arranged, positioned, and/or configured without departing from the disclosure. For example, the blank 3 could have any suitable number of panels and any suitable shape for the perimeter around the bottom panel 11.

Figure 2:
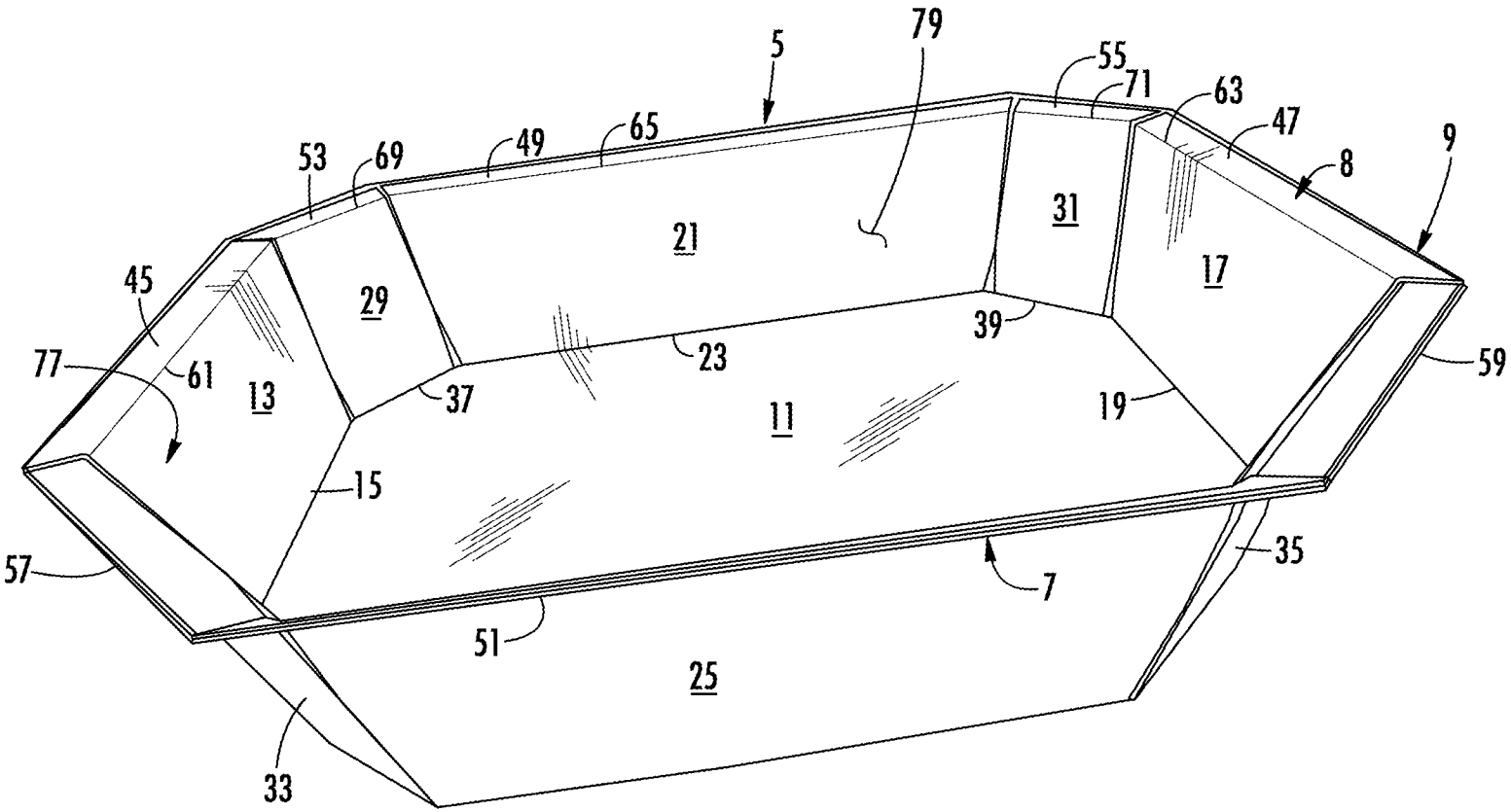
FIG. 2 is a perspective view of the container formed from the blank of FIG. 1 according to the first exemplary embodiment of the disclosure.
Figure 3:
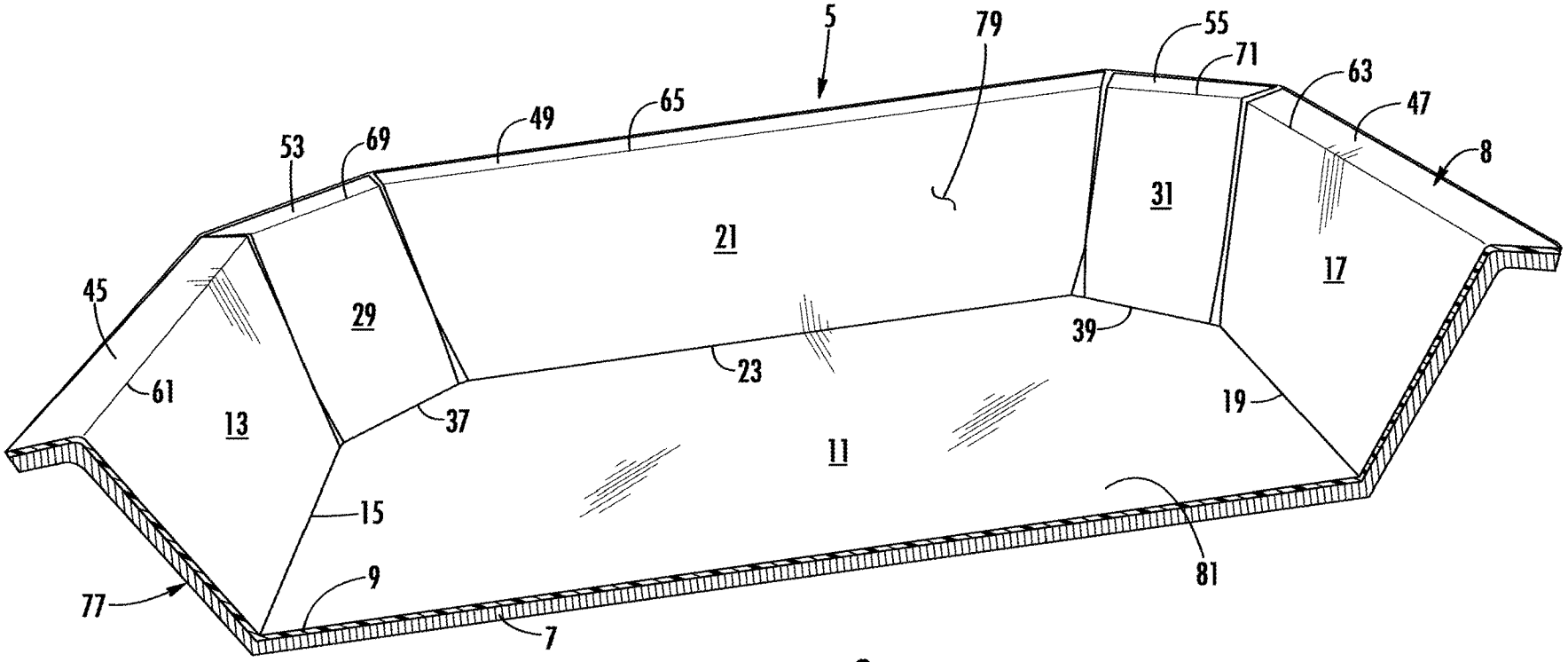
FIG. 3 is a perspective cross-section of the container of FIG. 2, the cross-section being taken through a longitudinal centerline of the container.

As shown in FIG. 2, the container 5 can be formed from the blank 3 by folding the end panels 13, 17, the side panels 21, 23, and the corner panels 29, 31, 33, 35 upwardly along the respective fold lines 15, 19, 23, 27, 37, 39, 41, 43 to form an octagonal sidewall 77 extending around the octagonal perimeter of the bottom panel 11. In one embodiment, the sidewall 77 extends obliquely upwardly and outwardly from the bottom panel 11 around the perimeter of the container 5. In the illustrated embodiment, the flange portions 45, 47, 49, 51, 53, 55, 57, 59 are folded along respective fold lines 61, 63, 65, 67, 69, 71, 73, 75 to extend outwardly from the respective end panels 13, 17, side panels 21, 25, and corner panels 29, 31, 33, 35 and are generally parallel to the bottom panel 11. As shown in FIGS. 2 and 3, the flange portions 45, 47, 49, 51, 53, 55, 57, 59 form a flange 8 that extends outwardly from the sidewall 77 around the perimeter of the container 5. In one embodiment, the sidewall 77 can extend along substantially the entire perimeter of the bottom panel 11, and the flange 8 can extend along substantially the entire perimeter of the sidewall 77. As shown in FIG. 2, each of the end panels 13, 17, the side panels 21, 25, the corner panels 29, 31, 33, 35, and the flange portions 45, 47, 49, 51, 53, 55, 57, 59 of the sidewall 77 can be oblique with respect to the respectively adjacent panels and can form an obtuse angle with each of the respectively adjacent panels. Also as shown in FIG. 2, the sidewall 77 and the bottom panel 11 define an interior 79 of the container 5 and have an inner surface 81 extending along the interior 79. The flange 8, the sidewall 77, and/or the bottom panel 11 could be omitted or could be otherwise shaped, arranged, positioned, and/or configured without departing from the disclosure. Also, the container 5 can have one or more injection-molded features that can reinforce the flange 8 and/or other portions of the container without departing from the disclosure.

In the illustrated embodiment, the container 5 is further formed by attaching the liner 9 to the inner surface 81 of the base layer 7 formed from the blank 3. As shown in the perspective cross-sectional view of FIG. 3, the liner 9 can extend over the bottom panel 11, the sidewall 77, and the flange 8. In the illustrated embodiment, the liner 9 can be attached to at least a portion of each of the bottom panel 11, the end panels 13, 17, the side panels 21, 25, the corner panels 29, 31, 33, 35, and the flange portions 45, 47, 49, 51, 53, 55, 57, 59. In one embodiment, the liner 9 can at least partially retain the base layer 7 in the shape of the sidewall 77 and the container 5 in general (e.g., can help prevent the end panels 13, 17, the side panels 21, 25, and the corner panels 29, 31, 33, 35 from separating from one another). As shown in FIGS. 2 and 3, the thickness of the liner 9 is exaggerated in order to illustrate the configuration of the liner 9 in the container 5. The container 5, including the liner 9 and/or the base layer 7, could be otherwise shaped, arranged, positioned, and/or configured without departing from the disclosure.

Figure 4:
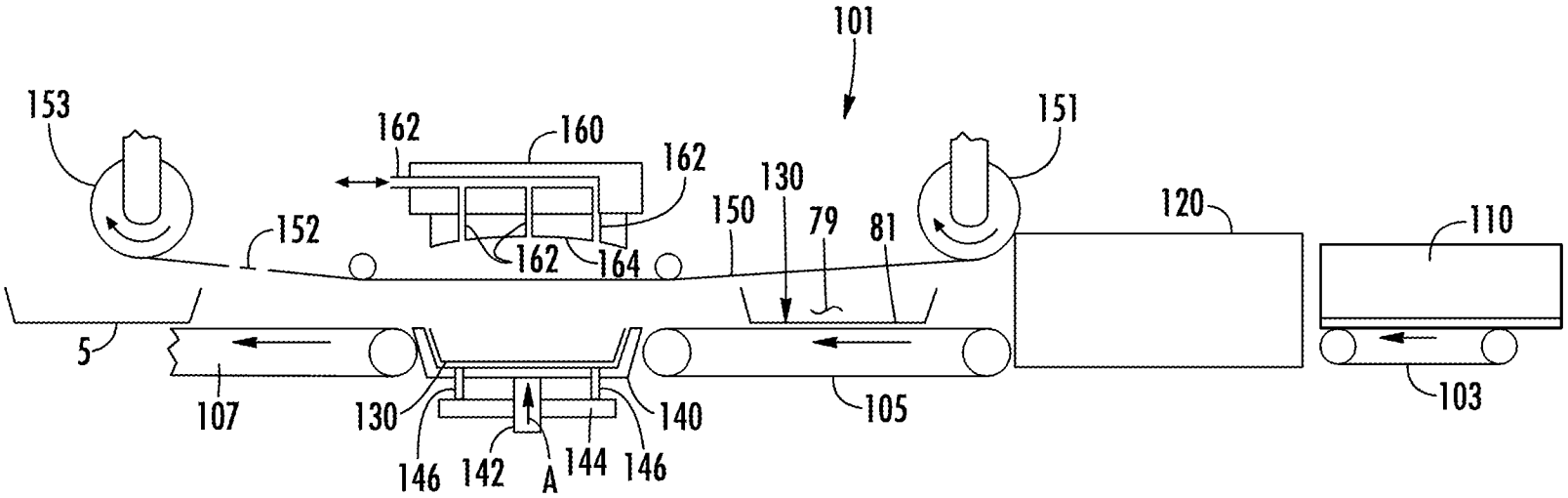
FIG. 4 is a schematic of an apparatus for forming a container of one embodiment of the disclosure.

FIG. 4 shows one embodiment of a system 101 and method for forming the container 5 that has the base layer 7 formed from the blank 3 and the inner layer 9. As shown in FIG. 4, the system includes a stack 110 of blanks 3 that are conveyed by a conveyor 103 to a container forming mechanism 120. In one embodiment, the container forming mechanism 120 can be any suitable mechanism or forming tool that can fold and/or press-form the blank 3 into the container 5, which can be similar to and have similar features and/or components as conventional forming tools such as are disclosed in U.S. Pat. No. 8,534,460, issued Sep. 17, 2013, the entire contents of which are incorporated herein by reference for all purposes. Also, the forming tool can have similar features and components such as the forming tool disclosed in U.S. Pat. No. 8,801,995, issued Aug. 12, 2014, the entire contents of which are incorporated by reference for all purposes, or any other suitable forming tool assembly. The mechanism 120 folds the end panels 13, 17, side panels 21, 25 and corner panels 29, 31, 33, 35 relative to the bottom panel 11 to form an unlined initial construct 130 that comprises the base layer 7 only. The initial construct 130 can be fed to a lower die 140 by a conveyor 105 and a PET plastic film sheet 150 can be fed from a supply roller 151 above the initial construct 130, the film sheet 150 having a thickness between approximately 30 and 150 microns in one exemplary embodiment. In one exemplary embodiment, the liner material can be a PET film having a thickness of approximately 50 microns and having a heat seal coating on the side that is attached to the base 7. Alternatively, the film sheet 150 could have any suitable thickness.

In one embodiment, the film sheet 150 could have perforations or other features (not shown) to help separate the liner material from the remainder of the sheet 150 when forming the container 5. An upper die 160 has a heater plate surface 164 having a PTFE coating, for example a Teflon® coating. Alternatively, the heater plate surface 164 could have a coating of any suitable material or the coating could be omitted. In the illustrated embodiment, the lower die 140 is raised in the direction of arrow A toward the upper die 160 by means of a pneumatic ram 142, and an initial vacuum is applied to ducts 162 to draw the film sheet 150 toward the upper die 160. In the illustrated embodiment, the upper die 160 is heated to a temperature of approximately 110 to 200 degrees Celsius or any other suitable temperature. At this temperature the liner material portion of the film sheet 150 softens and forms a domed shape (not shown) under the influence of the initial vacuum. In one embodiment, the film can at least partially conform to the concave heater plate surface 164 to form the domed shape. Instead of, or in addition to, the initial vacuum, air pressure under the film sheet 150 can be employed with similar or equal effect.

In the illustrated embodiment, as the film sheet 150 is domed, its temperature increases such that it becomes tacky. Subsequently, film sheet 150 can be forced against the inner surface 81 of the recess 79 of the initial construct 130 by means of air pressure either now applied to the ducts 162 and/or by means of a further vacuum applied from the bottom side of the film sheet 150. This pressure and/or further vacuum causes the dome shape of the liner material to invert, and the now tacky and stretched liner material of the film sheet 150 can adhere smoothly to the inner surface 81 of the initial construct 130 supported on the lower die 140. In one embodiment, the tackiness of the liner material can cause the liner material to adhere to the base layer 7. The PTFE coated surface 164 can aid in the release of the now tacky liner material portion of the film sheet 150 should the film sheet 150 make contact with the surface 164. The excess or waste portion of the film sheet 150 is cut form the edges of the container 5, that now includes the base layer 7 formed from the construct 150 and the liner 9 formed from liner material of the film sheet 150, by known means to leave an unused film portion 152 with tray sized apertures. In one embodiment, the unused film portion 152 has marginal portions that remain intact around the apertures formed by the removal of the inner layer 9 from the film 150 so that the unused film portion 152 can continue to the take-up reel 153. Alternatively, or in addition, the film sheet 150 can have a sacrificial carrier layer (not shown) wherein the liner material separates from the carrier sheet when it is attached to the base layer 7.

In the illustrated embodiment, the lower die 140 is lowered by reversing the direction of the ram 142, and a product support plate 144 can force the lined container 5 from the supporting lower die 140 as the ram 142 is lowered in order to eject the container 5 from the lower die 140. In one embodiment, the product support plate 144 can include upward extensions 146 that extend through the lower die 140 and engage the bottom of the container 5 due to the relative motion of the product support plate 144 and the lower die 140 toward one another. In the illustrated embodiment, the upward extensions 146 can position the container 5 relative to the lower die 140 so that a pusher rod, a puff of air, or other suitable mechanism can urge the container 5 onto a downstream conveyor 107. The lined container 5 then can be conveyed for packaging and/or further processing by the conveyor 107.

In one embodiment, the above mentioned process can be repeated to allow substantially continuous production of the lined containers 5. Since the above mentioned process can be employed in a variety of products and using different materials, it may be necessary to repeat the steps of heating the film and it may be necessary to then further force the film against the tray with air pressure, a vacuum, and/or another suitable mechanism. In particular, where thicker sheets of lining film are used for the inner layer 9 and various thicknesses of paperboard or other materials are used for the base layer 7, one or more repeats of the heating and forcing steps may be required in order for the film 9 to adhere to the base layer 7 tray effectively.

The system 101 and method described herein can include other features, steps, and/or the features and steps described herein can be omitted or modified without departing from the scope of the disclosure.

In one embodiment, the container 5, with the corner panels 29, 31, 33, 35 that extend obliquely between adjacent end panels 13, 17 and side panels 21, 25, generally includes only obtuse angles between the panels and lacks orthogonal angles. This can help enable the liner material that forms the liner 9 to come into contact with more of the surface area of the base layer 7 (e.g., relative to a base layer with orthogonal or acute angles, wherein it can be more difficult for the liner material to extend into such corners). Accordingly, the octagonal shape of the sidewall 77 can help the liner 9 to adhere to the entire surface or to substantially the entire surface of the base layer 7 of the container. In one embodiment, the octagonal shape of the sidewall 77 can more closely approximate a rounded or circular sidewall than a container with four orthogonal sides.

The manufacturing process described above produces a readily sealable tray which is made mainly from readily recyclable materials (e.g. paperboard or cardboard and thermoplastic materials). If required, the paperboard base layer is readily removable from the thermoplastic film liner (e.g., after use of the container to hold a food product during heating in a microwave oven and/or in a conventional oven) because the degree of adherence between the base layer 7 and the liner 9 is controllable to give sufficient adherence so that the liner and the base layer remain attached before, during, and/or after heating of an item held in the container while allowing selective separation of the base layer and the liner after use. Using the parameters mentioned above, it has been found that the base layer 7 and the liner 9 of the container 5 are separable following heating of food in the container, such that the two peel apart, leaving no more than 5% of the thickness of the material of the base layer 7 stuck to the film of the inner layer 9 in one exemplary embodiment. The separated paperboard of the base layer 7 and the thermoplastic film of the inner layer 9 can be more easily recycled in separate waste streams (e.g., one for paper products and one for polymers) while minimizing the contamination of the liner material with paperboard.

Advantageously, the use of the heater plate 164 to heat the film sheet 150 prior to its application onto the initial construct 130 provides control of the temperature of the film sheet 150 and thus the strength of its adherence to the initial construct 130. The use of the heater plate 164 also allows differential heating, so, for example, the film sheet 150 could be heated to a higher temperature in the flange area 8 of the container 5, which in turn causes the liner 9 to adhere more strongly to the flange 8 than to the remainder of the container 5 so that a further tray-sealing film applied to the liner 9 in the area of the flange has a more secure anchor to the container 5. In one embodiment, no injection molding features are used for the container 5 and a thinner plastic film can be employed, which can reduce the non-recyclable material content of the tray.

A PET plastics film 150 has been described above, although it will be understood that other plastics films could be used, for example polyester based polymers could be used. Also a polyethylene could be used and is favored for food packaging that is not heated (e.g., sandwich packs). It can be seen that the disclosure provides in one embodiment food packaging having a composite construction of a plastics inner food-contacting layer 9, bonded to an outer recyclable layer 7, the inner and outer layers being separable after use, such that no more than 5% of the thickness of the outer layer is disposed on the inner layer after separation.

In one embodiment, a lid (not shown) can comprise packaging film that is a thin plastic layer used to preserve and protect a food item contained in the tray and can be removably attached to the flange 8 of the container 5. Any plastic film, such as polyethylene, polypropylene, polyethylene terephthalate, polyvinylchloride, polyamide, and ethylene vinyl alcohol, or other suitable material, can be used for forming the lid that is sealed against the sealing surface of the flange 8. Further, adhesives can be used between the lid and the sealing surface of the flange 8 without departing from the disclosure.

Figure 5:
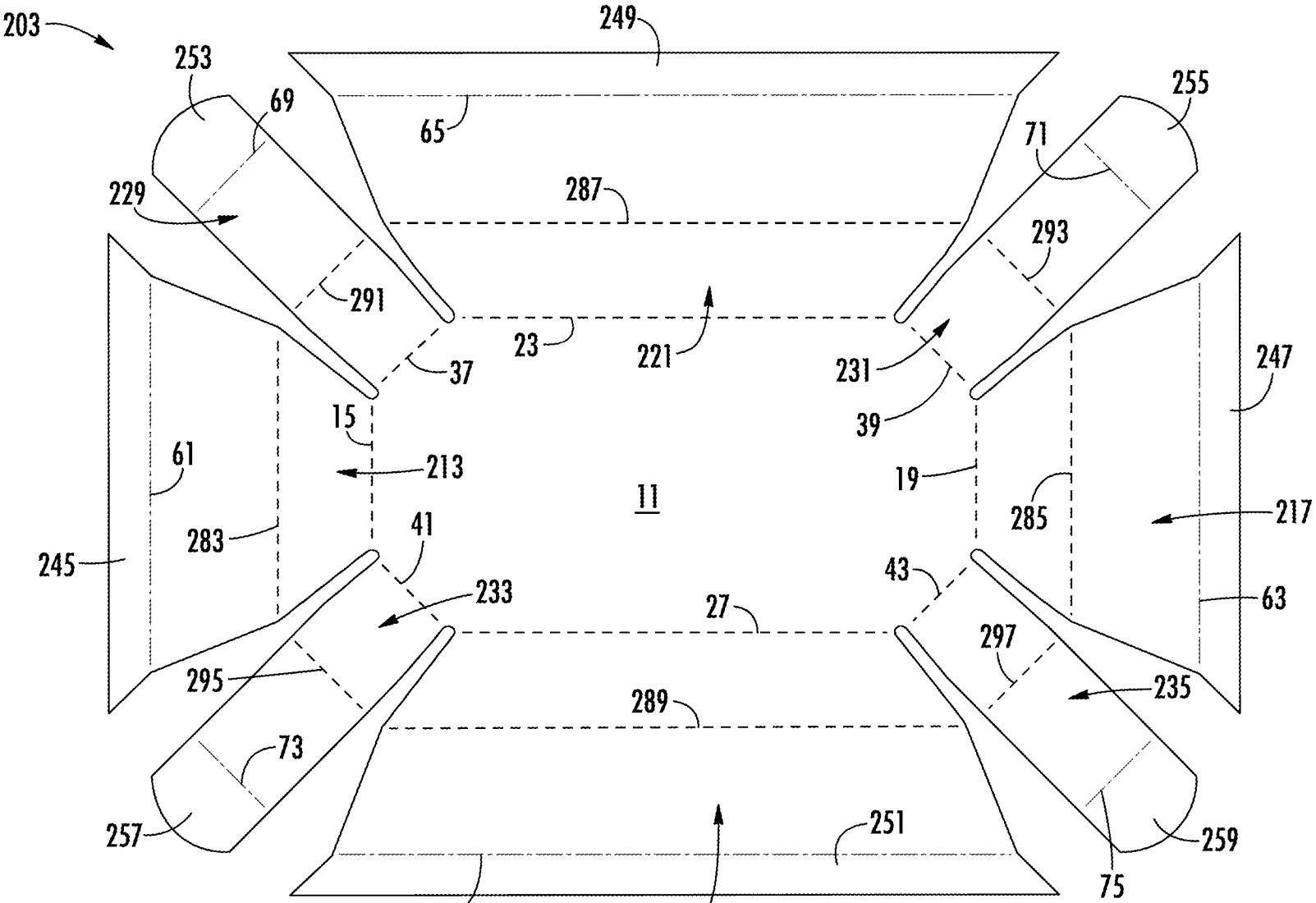
FIG. 5 is a plan view of a blank used for forming a container according to a second exemplary embodiment of the disclosure.

FIG. 5 is a plan view of a blank 203 for forming a container 205 (FIG. 6) of a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 5, the blank 203 is similar to the blank 3 of the first embodiment except that the end panels 213, 217, the side panels 221, 225, and the flange portions 245, 247, 249, 251 are shaped somewhat differently than the respective panels and flange portions of the first embodiment. In addition, the corner panels 229, 231, 233, 235 are differently shaped than the corner panels of the first embodiment, particularly at the flange portions 253, 255, 257, 259, which have rounded edges as shown in FIG. 5 and are larger than the flange portions of the first embodiment. As shown in FIG. 5, a lateral fold line 283, 285 extends across the respective end panels 213, 217, a longitudinal fold line 287, 289 extends across the respective side panels 221, 225, and an oblique fold line 291, 293, 295, 297 extends across each of the corner panels 229, 231, 233, 235. The blank 203 could be otherwise shaped, arranged, and/or configured without departing from the disclosure.

Figure 6:
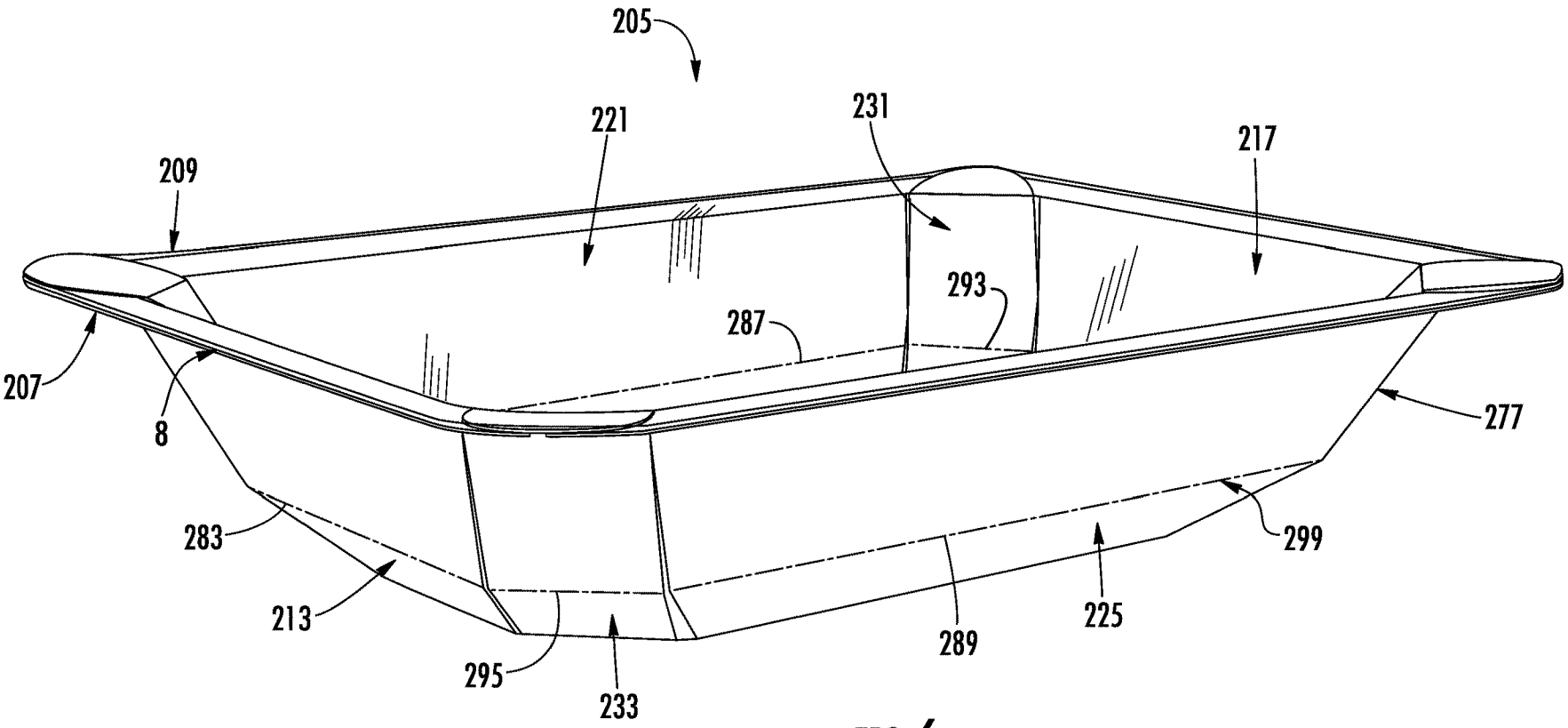
FIG. 6 is a perspective view of the container formed from the blank of FIG. 5 according to the second exemplary embodiment of the disclosure.

In the illustrated embodiment, the container 205 can be formed from the blank 203 and the liner material (e.g., the liner material 150) in a similar or the same manner as described above with respect to the first embodiment. Accordingly, the container 205 can include the base layer 207 formed from the blank 203 (e.g., a solid bleached sulphate folding boxboard) and the liner 209 formed from the liner material 150 (e.g., a PET film with a thickness of approximately 50 microns and with a heat seal coating). As shown in FIG. 6, each of the corner flange portions 253, 255, 257, 259 can overlap a portion of the respectively adjacent flange portions of the end panels and side panels.

As shown in FIG. 6, the lateral fold lines 283, 285, the longitudinal fold lines 287, 289, and the oblique fold lines 291, 293, 295, 297 can cooperate to form an intermediate fold line 299 extending around the sidewall 277. In the illustrated embodiment, the sidewall 277 can have a lower portion and an upper portion each extending from the intermediate fold line 299, wherein the portions of the sidewall 277 are oblique with respect to one another. In one embodiment, the upper and lower portions of the sidewall can cooperate to form an obtuse angle, and the lower portion of the sidewall 277 can form a more obtuse angle with the bottom panel 11 than the angle between the sidewall 77 and the bottom panel 11 in the first embodiment. The obtuse angles in the sidewall 277 can allow the base layer 207 to conform with the liner 209 more completely, which can increase the contact between the surfaces of the base layer 207 and the liner 209 (e.g., at the transitions between the panels of the container 205). The container 205 could be otherwise shaped, arranged, and/or configured without departing from the disclosure.

Any of the features of the various embodiments of the disclosure can be combined with, replaced by, or otherwise configured with other features of other embodiments of the disclosure without departing from the scope of this disclosure.

Optionally, one or more portions of the blank or other constructs described herein or contemplated hereby may be coated with varnish, clay, or other materials, either alone or in combination. The coating may then be printed over with product advertising or other information or images. The blanks or other constructs also may be selectively coated and/or printed so that less than the entire surface area of the blank or substantially the entire surface area of the blank may be coated and/or printed.

Any of the blanks, containers, or other constructs of this disclosure may optionally include one or more features that alter the effect of microwave energy during the heating or cooking of a food item that is associated with the tray or other construct. For example, the blank, tray, container, or other construct may be formed at least partially from one or more microwave energy interactive elements (hereinafter sometimes referred to as "microwave interactive elements") that promote heating, browning and/or crisping of a particular area of the food item, shield a particular area of the food item from microwave energy to prevent overcooking thereof, or transmit microwave energy towards or away from a particular area of the food item. Each microwave interactive element comprises one or more microwave energy interactive materials or segments arranged in a particular configuration to absorb microwave energy, transmit microwave energy, reflect microwave energy, or direct microwave energy, as needed or desired for a particular construct and food item.

In the case of a susceptor or shield, the microwave energy interactive material may comprise an electroconductive or semiconductive material, for example, a vacuum deposited metal or metal alloy, or a metallic ink, an organic ink, an inorganic ink, a metallic paste, an organic paste, an inorganic paste, or any combination thereof. Examples of metals and metal alloys that may be suitable include, but are not limited to, aluminum, chromium, copper, inconel alloys (nickel-chromium-molybdenum alloy with niobium), iron, magnesium, nickel, stainless steel, tin, titanium, tungsten, and any combination or alloy thereof.

Alternatively, the microwave energy interactive material may comprise a metal oxide, for example, oxides of aluminum, iron, and tin, optionally used in conjunction with an electrically conductive material. Another metal oxide that may be suitable is indium tin oxide (ITO). ITO has a more uniform crystal structure and, therefore, is clear at most coating thicknesses.

Alternatively still, the microwave energy interactive material may comprise a suitable electroconductive, semiconductive, or non-conductive artificial dielectric or ferroelectric. Artificial dielectrics comprise conductive, subdivided material in a polymeric or other suitable matrix or binder, and may include flakes of an electroconductive metal, for example, aluminum.

In other embodiments, the microwave energy interactive material may be carbon-based, for example, as disclosed in U.S. Pat. Nos. 4,943,456, 5,002,826, 5,118,747, and 5,410,135.

In still other embodiments, the microwave energy interactive material may interact with the magnetic portion of the electromagnetic energy in the microwave oven. Correctly chosen materials of this type can self-limit based on the loss of interaction when the Curie temperature of the material is reached. An example of such an interactive coating is described in U.S. Pat. No. 4,283,427.

The use of other microwave energy interactive elements is also contemplated. In one example, the microwave energy interactive element may comprise a foil or high optical density evaporated material having a thickness sufficient to reflect a substantial portion of impinging microwave energy. Such elements typically are formed from a conductive, reflective metal or metal alloy, for example, aluminum, copper, or stainless steel, in the form of a solid "patch" generally having a thickness of from about 0.000285 inches to about 0.005 inches, for example, from about 0.0003 inches to about 0.003 inches. Other such elements may have a thickness of from about 0.00035 inches to about 0.002 inches, for example, 0.0016 inches.

In some cases, microwave energy reflecting (or reflective) elements may be used as shielding elements where the food item is prone to scorching or drying out during heating. In other cases, smaller microwave energy reflecting elements may be used to diffuse or lessen the intensity of microwave energy. One example of a material utilizing such microwave energy reflecting elements is commercially available from Graphic Packaging International, Inc. (Marietta, Ga.) under the trade name MicroRite® packaging material. In other examples, a plurality of microwave energy reflecting elements may be arranged to form a microwave energy distributing element to direct microwave energy to specific areas of the food item. If desired, the loops may be of a length that causes microwave energy to resonate, thereby enhancing the distribution effect. Microwave energy distributing elements are described in U.S. Pat. Nos. 6,204,492, 6,433,322, 6,552,315, and 6,677,563, each of which is incorporated by reference in its entirety.

If desired, any of the numerous microwave energy interactive elements described herein or contemplated hereby may be substantially continuous, that is, without substantial breaks or interruptions, or may be discontinuous, for example, by including one or more breaks or apertures that transmit microwave energy. The breaks or apertures may extend through the entire structure, or only through one or more layers. The number, shape, size, and positioning of such breaks or apertures may vary for a particular application depending on the type of construct being formed, the food item to be heated therein or thereon, the desired degree of heating, browning, and/or crisping, whether direct exposure to microwave energy is needed or desired to attain uniform heating of the food item, the need for regulating the change in temperature of the food item through direct heating, and whether and to what extent there is a need for venting.

By way of illustration, a microwave energy interactive element may include one or more transparent areas to effect dielectric heating of the food item. However, where the microwave energy interactive element comprises a susceptor, such apertures decrease the total microwave energy interactive area, and therefore, decrease the amount of microwave energy interactive material available for heating, browning, and/or crisping the surface of the food item. Thus, the relative amounts of microwave energy interactive areas and microwave energy transparent areas may be balanced to attain the desired overall heating characteristics for the particular food item.

As another example, one or more portions of a susceptor may be designed to be microwave energy inactive to ensure that the microwave energy is focused efficiently on the areas to be heated, browned, and/or crisped, rather than being lost to portions of the food item not intended to be browned and/or crisped or to the heating environment. Additionally or alternatively, it may be beneficial to create one or more discontinuities or inactive regions to prevent overheating or charring of the food item and/or the construct including the susceptor.

As still another example, a susceptor may incorporate one or more "fuse" elements that limit the propagation of cracks in the susceptor, and thereby control overheating, in areas of the susceptor where heat transfer to the food is low and the susceptor might tend to become too hot. The size and shape of the fuses may be varied as needed. Examples of susceptors including such fuses are provided, for example, in U.S. Pat. Nos. 5,412,187, 5,530,231, U.S. Patent Application Publication No. US 2008/0035634A1, published Feb. 14, 2008, and PCT Application Publication No. WO 2007/127371, published Nov. 8, 2007, each of which is incorporated by reference herein in its entirety.

All dimensional information presented herein is intended to be illustrative of certain aspects, features, etc., of various embodiments of the disclosure, and is not intended to limit the scope of the disclosure. The dimensions of the blanks, containers, forming tools, features, or any other dimension, can be more or less than what is shown and described in this disclosure without departing from the scope of this disclosure and can be within the listed ranges of dimensions for each feature or outside the listed ranges of dimensions for each feature without departing from the scope of this disclosure.

The blanks according to the present invention can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blanks. The blanks may also be coated with, for example, a moisture barrier layer, on either or both sides of the blanks.

In accordance with the exemplary embodiments, the blanks may be constructed of paperboard of a caliper such that it is heavier and more rigid than ordinary paper. The blanks can also be constructed of other materials, such as cardboard, hard paper, or any other material having properties suitable for enabling the carton package to function at least generally as described above.

The foregoing description illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, and alterations, etc., of the above-described embodiments. Additionally, the disclosure shows and describes only selected embodiments, but various other combinations, modifications, and environments are contemplated and are within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments without departing from the scope of the disclosure.

What is claimed is:

1. A container for heating a food product, the container comprising:

a base layer of material and a liner releasably attached to an inner surface of the base layer, wherein the liner is separable from the base layer after heating the container;

a bottom panel;

an end panel foldably connected to the bottom panel;

a side panel foldably connected to the bottom panel;

a corner panel foldably connected to the bottom panel, the corner panel extending between the end panel and the side panel;

a sidewall extending around the bottom panel, wherein the sidewall comprises the end panel, the side panel, and the corner panel, and the sidewall and the bottom panel at least partially define an interior of the container; and a flange extending outwardly from the sidewall, the flange extending along a perimeter of the sidewall, wherein the end panel comprises an end flange portion, the side panel comprises a side flange portion, and the corner panel comprises a corner flange portion, the end flange portion, the side flange portion, and the corner flange portion cooperate to at least partially form the flange, and the corner flange portion is in an overlapping relationship with each of the end flange portion and the side flange portion;

wherein the sidewall comprises a lower portion foldably connected to an upper portion along an intermediate fold line extending in the sidewall, the upper portion is oblique with respect to the lower portion, and the intermediate fold line extends in at least the end panel, the side panel, and the corner panel.

2. The container of claim 1, wherein the corner panel is oblique with respect to the side panel and the end panel.

3. The container of claim 1, wherein the corner panel forms an obtuse angle with each of the side panel and the end panel.

4. The container of claim 1, wherein the side panel is a first side panel, the corner panel is a first corner panel, and the container further comprises a second side panel foldably connected to the bottom panel and a second corner panel foldably connected to the bottom panel, the second side panel being disposed opposite to the first side panel and the second corner panel extending between the end panel and the second side panel.

5. The container of claim 1, wherein the end panel is a first end panel, the corner panel is a first corner panel, and the container further comprises a second end panel foldably connected to the bottom panel and a second corner panel foldably connected to the bottom panel, the second end panel being disposed opposite to the first end panel and the second corner panel extending between the side panel and the second end panel.

6. The container of claim 1, wherein the sidewall extends around an octagonal perimeter of the bottom panel.

7. The container of claim 1, wherein the sidewall comprises eight panels, each panel of the eight panels is foldably connected to the bottom panel along a respective fold line, and the fold lines form an octagonal perimeter of the bottom panel.

8. The container of claim 1, wherein the sidewall and the bottom panel at least partially define an interior space of the container, and the intermediate fold line extends around the interior space.

9. The container of claim 1, wherein the liner is releasably attached to at least a portion of each of the end panel, the side panel, the corner panel, and the flange.

10. The container of claim 1, wherein the base layer comprises paperboard, the liner comprises a thermoplastic material with a thickness between approximately 30 microns to approximately 150 microns.

11. The container of claim 10, wherein the thermoplastic material comprises polyethylene terephthalate with a heat seal coating on at least one surface.

12. The container of claim 1, wherein the liner is releasably attached to at least a portion of each of the end panel, the side panel, and the corner panel.

13. The container of claim 1, wherein the intermediate fold line comprises a lateral fold line extending across the end panel, a longitudinal fold line extending across the side panel, and an oblique fold line extending across the corner panel, each of the lateral fold line, the longitudinal fold line, and the oblique fold line being spaced apart from the bottom panel and from an upper perimeter of the container.

14. In combination, a blank and a liner material for forming a container for heating a food product, the blank comprising:

a bottom panel;

an end panel foldably connected to the bottom panel, the end panel comprising an end flange portion;

a side panel foldably connected to the bottom panel, the side panel comprising a side flange portion; and a corner panel foldably connected to the bottom panel, the corner panel comprising a corner flange portion, the corner panel being disposed between the end panel and the side panel so that the corner panel extends between the end panel and the side panel when the container is formed from the blank and the liner material;

wherein the blank is for forming a base layer of the container, and the liner material is for being releasably attached to an inner surface of the base layer when the container is formed from the blank and the liner material so that the liner is separable from the base layer after heating of the container formed from the blank and the liner material;

wherein the end panel, the side panel, and the corner panel are for at least partially forming a sidewall extending around the bottom panel when the container is formed from the blank and the liner material;

wherein the flange portions cooperate to at least partially form a flange of the container formed from the blank and the liner material, and the corner flange portion is in an overlapping relationship with each of the end flange portion and the side flange portion when the container is formed from the blank and the liner material;

wherein, when the container is formed from the blank and the liner material, the sidewall comprises a lower portion foldably connected to an upper portion along an intermediate fold line extending in the sidewall, the upper portion is oblique with respect to the lower portion, and the intermediate fold line extends in at least the end panel, the side panel, and the corner panel.

15. The combination of claim 14, wherein the end panel is foldably connected to the bottom panel along a first fold line, the side panel is foldably connected to the bottom panel along a second fold line, the corner panel is foldably connected to the bottom panel along a third fold line, and the third fold line is oblique with respect to the first fold line and the second fold line.

16. The combination of claim 14, wherein the end panel is foldably connected to the bottom panel along a first fold line, the side panel is foldably connected to the bottom panel along a second fold line, the corner panel is foldably connected to the bottom panel along a third fold line, and the third fold line forms an obtuse angle with each of the first fold line and the second fold line.

17. The combination of claim 14, wherein the side panel is a first side panel, the corner panel is a first corner panel, and the container further comprises a second side panel foldably connected to the bottom panel and a second corner panel foldably connected to the bottom panel, the second side panel being disposed opposite to the first side panel and the second corner panel being disposed between the end panel and the second side panel so that the second corner panel extends between the end panel and the second side panel when the container is formed from the blank and the liner material.

18. The combination of claim 14, wherein the end panel is a first end panel, the corner panel is a first corner panel, and the container further comprises a second end panel foldably connected to the bottom panel and a second corner panel foldably connected to the bottom panel, the second end panel being disposed opposite to the first end panel and the second corner panel being disposed between the second end panel and the side panel so that the second corner panel extends between the second end panel and the side panel when the container is formed from the blank and the liner material.

19. The combination of claim 14, further comprising a plurality of panels comprising the end panel, the side panel, and the corner panel, wherein the plurality of panels are for forming the sidewall when the container is formed from the blank and the liner material, the plurality of panels comprises eight panels, each panel of the eight panels is foldably connected to the bottom panel along a respective fold line, and the fold lines form an octagonal perimeter of the bottom panel.

20. The combination of claim 14, further comprising a plurality of panels foldably connected to the bottom panel, wherein the plurality of panels are for forming the sidewall when the container is formed from the blank and the liner material, the plurality of panels comprises the end panel, the side panel, and the corner panel, the plurality of panels comprises a plurality of flange portions respectively extending from respective panels of the plurality of panels, the plurality of flange portions comprises the end flange portion, the side flange portion, and the corner flange portion, the plurality of flange portions being for at least partially forming the flange extending from the sidewall when the container is formed from the blank and the liner material.

21. The combination of claim 20, wherein the liner material is for being releasably attached to at least a portion of each panel of the plurality of panels and to at least a portion of each flange portion of the plurality of flange portions when the container is formed from the blank and the liner material.

22. The combination of claim 14, wherein the liner material is for being releasably attached to at least a portion of each of the end panel, the side panel, and the corner panel, and to each of the end flange portion, the side flange portion, and the corner flange portion when the container is formed from the blank and the liner material.

23. The combination of claim 14, wherein the base layer comprises paperboard, the liner material comprises a thermoplastic material with a thickness between approximately 30 microns to approximately 150 microns.

24. The combination of claim 23, wherein the thermoplastic material comprises polyethylene terephthalate.

25. The combination of claim 14, wherein the liner material is for being releasably attached to at least a portion of each of the end panel, the side panel, and the corner panel when the container is formed from the blank and the liner material.

26. The combination of claim 14, wherein the intermediate fold line comprises a lateral fold line extending across the end panel, a longitudinal fold line extending across the side panel, and an oblique fold line extending across the corner panel, each of the lateral fold line, the longitudinal fold line, and the oblique fold line being spaced apart from the bottom panel and from a respective outer edge of the respective end panel, side panel, and corner panel.

27. A method of forming a container comprising:

obtaining a blank comprising a bottom panel, an end panel foldably connected to the bottom panel, a side panel foldably connected to the bottom panel, and a corner panel foldably connected to the bottom panel, the end panel comprises an end flange portion, the side panel comprises a side flange portion, and the corner panel comprises a corner flange portion;

forming the blank into an initial construct by folding the end panel, the side panel, and the corner panel with respect to the bottom panel so that the corner panel extends between the end panel and the side panel, wherein the forming the blank into the initial construct comprises forming a sidewall extending around the bottom panel, the sidewall comprising the end panel, the side panel, and the corner panel, the sidewall and the bottom panel at least partially define an interior of the container, and wherein the forming the blank into the initial construct further comprises forming a flange extending outwardly from the sidewall and along a perimeter of the sidewall, the flange comprising the end flange portion, the side flange portion, and the corner flange portion, and the forming the flange comprising positioning the corner flange portion in an overlapping relationship with each of the end flange portion and the side flange portion; and applying a liner material to an inner surface of the initial construct so that the liner material and the initial construct form a respective liner and base layer of the container and so that the liner is releasably attached to the inner surface of the base layer, the liner being separable from the base layer after heating of the container;

wherein the sidewall comprises a lower portion foldably connected to an upper portion along an intermediate fold line extending in the sidewall, the upper portion is oblique with respect to the lower portion, and the intermediate fold line extends in at least the end panel, the side panel, and the corner panel.

28. The method of claim 27, wherein the applying the liner material to the initial construct comprises heating the liner material so that at least a portion of the liner material becomes tacky and then bringing the liner material into contact with the initial construct.

29. The method of claim 28, wherein the liner material comprises a thermoplastic material, and the heating the liner material comprises heating the liner material to between approximately 110 to approximately 200 degrees Celsius.

30. The method of claim 29, wherein the liner material has a thickness between approximately 30 microns to approximately 150 microns.

31. The method of claim 28, wherein the heating the liner material comprises moving at least a portion of the liner material toward a heater plate and the bringing the liner material into contact with the initial construct comprises moving at least the portion of the liner material away from the heater plate toward the initial construct.

32. The method of claim 31, wherein the moving at least the portion of the liner material toward the heater plate and the moving at least the portion of the liner material away from the heater plate comprises applying at least one of vacuum pressure and air pressure to at least one side of the liner material.

33. The method of claim 27, wherein the folding the end panel, the side panel, and the corner panel comprises positioning the corner panel to form an obtuse angle with each of the side panel and the end panel.

34. The method of claim 27, wherein the sidewall extends around an octagonal perimeter of the bottom panel.

35. The method of claim 27, wherein the applying the liner material to the initial construct comprises bringing the liner material into contact with at least a portion of each of the bottom panel, the sidewall, and the flange.

* * * * *